US008757412B2

(12) United States Patent
Sommer et al.

(10) Patent No.: US 8,757,412 B2
(45) Date of Patent: Jun. 24, 2014

(54) FOLDABLE CONTAINER WITH ACCESS OPENING

(75) Inventors: Axel Sommer, Tacoma, WA (US); Henning Rader, Middleburg, VA (US)

(73) Assignee: Monoflo International, Inc., Winchester, VA (US)

( * ) Notice: Subject to any disclaimer, the term of this patent is extended or adjusted under 35 U.S.C. 154(b) by 0 days.

(21) Appl. No.: 13/345,965

(22) Filed: Jan. 9, 2012

(65) Prior Publication Data

US 2013/0175265 A1 Jul. 11, 2013

(51) Int. Cl.
*B65D 6/26* (2006.01)
*B65D 6/16* (2006.01)

(52) U.S. Cl.
CPC ... *B65D 7/30* (2013.01); *B65D 7/24* (2013.01)
USPC ..... 220/4.33; 220/4.28; 220/7

(58) Field of Classification Search
USPC ..... 220/4.33, 4.01, 4.28, 4.22, 4.23, 4.29, 220/6, 7, 666; 16/321; 292/137
See application file for complete search history.

(56) References Cited

U.S. PATENT DOCUMENTS

| | | | | |
|---|---|---|---|---|
| 4,917,255 | A | 4/1990 | Foy et al. | |
| 5,038,953 | A | 8/1991 | Radar | |
| 5,285,900 | A | 2/1994 | Swingler | |
| 5,429,296 | A | 7/1995 | Southwell et al. | |
| 5,586,675 | A | 12/1996 | Borsboom et al. | |
| 5,601,202 | A | 2/1997 | Meacham et al. | |
| 5,711,444 | A | 1/1998 | Meacham et al. | |
| 5,788,103 | A | 8/1998 | Wagner et al. | |
| 6,015,056 | A | 1/2000 | Overholt et al. | |
| 6,098,827 | A | 8/2000 | Overholt et al. | |
| 6,209,742 | B1 | 4/2001 | Overholt et al. | |
| 6,290,081 | B1 | 9/2001 | Merey | |
| 6,293,418 | B1 | 9/2001 | Ogden et al. | |
| 6,302,323 | B1 | 10/2001 | Southwell | |
| 6,601,724 | B1 | 8/2003 | Koefelda et al. | |
| 6,669,044 | B2 | 12/2003 | Murakami et al. | |
| 6,772,897 | B2 | 8/2004 | Kellerer et al. | |
| 7,195,128 | B2 | 3/2007 | Murakami et al. | |
| 7,264,122 | B2 | 9/2007 | Koefelda et al. | |
| 7,370,771 | B2 | 5/2008 | Rader | |
| 7,416,092 | B2 | 8/2008 | Dubois et al. | |
| 7,484,634 | B2 | 2/2009 | Apps | |
| 7,677,434 | B2 | 3/2010 | Fry | |
| RE41,323 | E | 5/2010 | Kellerer et al. | |
| 7,780,067 | B2 | 8/2010 | Holley, Jr. | |
| 7,784,631 | B2 * | 8/2010 | Winn et al. | 220/6 |
| 7,828,167 | B2 | 11/2010 | Nolan | |
| 7,861,878 | B2 | 1/2011 | Escarpa Gil | |
| 7,896,184 | B2 | 3/2011 | Meers | |
| 8,109,402 | B2 * | 2/2012 | Hartwall | 220/7 |

(Continued)

*Primary Examiner* — Robert J Hicks
*Assistant Examiner* — Kareen Rush
(74) *Attorney, Agent, or Firm* — Nixon & Vanderhye P.C.

(57) ABSTRACT

A collapsible container includes a rectangular bottom wall and a plurality of walls pivotally connected to the bottom wall. The plurality of walls include first and second side walls disposed in facing relation and first and second end walls disposed in facing relation. An access door is provided in the first end wall. The access door is pivotable between a closed position and an open position. The first side wall is collapsible from an upstanding position to a collapsed position overlaying the bottom wall, the second side wall is collapsible from an upstanding position to a collapsed position overlaying the collapsed first side wall, and the first and second end walls are collapsible from an upstanding position to a collapsed position overlaying the second side wall.

16 Claims, 9 Drawing Sheets

(56) References Cited

U.S. PATENT DOCUMENTS

| | | | | |
|---|---|---|---|---|
| 8,413,831 | B2 * | 4/2013 | Nolan | 220/7 |
| 2002/0130167 | A1 | 9/2002 | Riedi | |
| 2002/0134823 | A1 | 9/2002 | Riedi | |
| 2003/0213835 | A1 | 11/2003 | Riedi | |
| 2005/0230464 | A1 | 10/2005 | Riedi | |
| 2007/0075077 | A1 | 4/2007 | Dubois et al. | |
| 2007/0125779 | A1 | 6/2007 | Cope | |
| 2008/0142530 | A1 | 6/2008 | Meers et al. | |
| 2009/0057320 | A1 | 3/2009 | Meers et al. | |
| 2009/0084783 | A1 | 4/2009 | Apps | |
| 2009/0101640 | A1 | 4/2009 | Hadar | |
| 2009/0205169 | A1 * | 8/2009 | Nolan et al. | 16/321 |
| 2009/0308866 | A1 | 12/2009 | Elvin-Jensen et al. | |
| 2011/0139775 | A1 | 6/2011 | Nolan | |
| 2011/0240637 | A1 | 10/2011 | Orgeldinger | |

* cited by examiner

FOLDABLE CONTAINER WITH ACCESS OPENING

BACKGROUND OF THE INVENTION

The invention relates to a foldable/collapsible container and, more particularly, to a foldable/collapsible container with an efficient folding sequence and an access opening.

Collapsible plastic containers are used in a variety of industrial and commercial applications. These containers offer the convenience of large holding capacity and, when collapsed, a minimum space requirement for storage. Exemplary collapsible plastic containers are described in commonly-owned U.S. Pat. No. 5,038,953 and U.S. Pat. No. 7,370,771, the disclosures of which are hereby incorporated by reference.

Existing collapsible containers typically operate in a similar manner. A top perimeter and bottom accept the attachment of side walls that are hinged to allow the entire assembly to be folded. Generally, the longer sides are constructed with two parts hinged in the middle and attached to both top perimeter and the bottom. The shorter sides or end walls are attached to the top perimeter or bottom and fold inward to collapse the container. Although this design is functionally efficient, the additional hinges in the longer sides complicate manufacture and assembly. Additionally, it is desirable to include an access opening/door to facilitate access to the product in the containers.

BRIEF SUMMARY OF THE INVENTION

The container of the described embodiments provides a unique solution for a foldable container with an access opening on the front end of the container in combination with the folding sequence of the side walls. In the folding/collapsing sequence, the walls on the long side of the container fold in first, and the short end walls, including the access door, are folded second.

Advantages of an access opening solution include the ability for personnel at the picking stations to have easier access to the product in the containers. Currently, personnel are required to use steps to reach into the container, which could result in accidents. Additionally, shelf space (height) could be reduced with containers still accessible from the front but not from the top.

In an exemplary embodiment, a collapsible container includes a rectangular bottom wall, and a plurality of walls pivotally connected to the bottom wall. The plurality of walls include first and second side walls disposed in facing relation and first and second end walls disposed in facing relation. An access door is provided in the first end wall. The access door is pivotable between a closed position and an open position. The first side wall is collapsible from an upstanding position to a collapsed position overlaying the bottom wall, the second side wall is collapsible from an upstanding position to a collapsed position overlaying the collapsed first side wall, and the first and second end walls are collapsible from an upstanding position to a collapsed position overlaying the second side wall.

A first pivot joint between the first side wall and the bottom wall may be spaced closer to the bottom wall than a second pivot joint between the second side wall and the bottom wall, thereby enabling the second side wall to be collapsed overlaying the first side wall.

The first end wall may include an opening in which the access door is disposed. The opening defines an inner perimeter of the first end wall. In this context, the access door may include a door latch movably secured in a channel in the access door, where the door latch is extendable into an opening in the inner perimeter. The door latch may be displaceable between a latched position, in which the door latch is extended into the opening in the inner perimeter, and a released position in which the door latch is retracted from the opening in the inner perimeter. Preferably, the door latch is biased toward the latched position.

Each of the side walls may be secured in an upstanding position via a wall latch releasably engageable with the first and second end walls. In this context, the container may include a latch handle cooperable with each of the wall latches, where the latch handle is displaceable upward relative to the bottom wall to release the wall latches.

In one arrangement, the first end wall is pivotable relative to the bottom wall regardless of a position of the access door.

In another exemplary embodiment, a method of collapsing a collapsible container includes the steps of (a) collapsing the first side wall from an upstanding position to a collapsed position overlaying the bottom wall; then, (b) collapsing the second side wall from an upstanding position to a collapsed position overlaying the collapsed first side wall; and then, (c) collapsing the first and second end walls from an upstanding position to a collapsed position overlaying the second side wall.

BRIEF DESCRIPTION OF THE DRAWINGS

These and other aspects and advantages of the invention will be described in detail with reference to the accompanying drawings, in which.

DETAILED DESCRIPTION OF THE INVENTION

Figure 1:
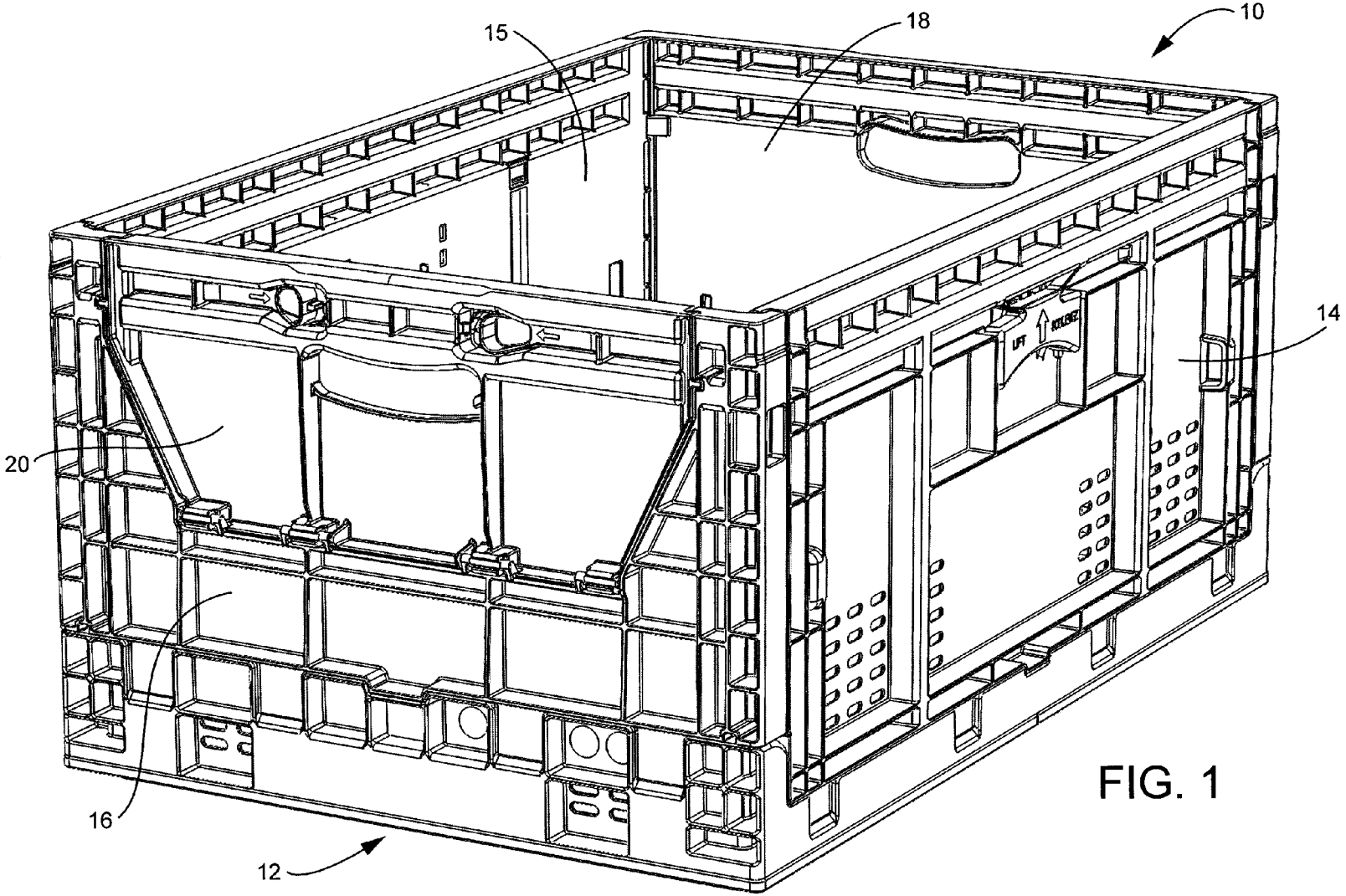
FIG. 1 is a perspective view of the collapsible container according to the described embodiments.

With reference to FIG. 1, a collapsible container 10 includes a generally rectangular bottom wall 12 and a plurality of walls pivotally connected to the bottom wall. The plurality of walls include first 14 and second 15 side walls disposed in facing relation and first 16 and second 18 end walls disposed in facing relation. An access door 20 is provided in the first end wall 16 and is pivotable between a closed position (FIG. 1) and an open position (FIG. 2).

Figure 2:
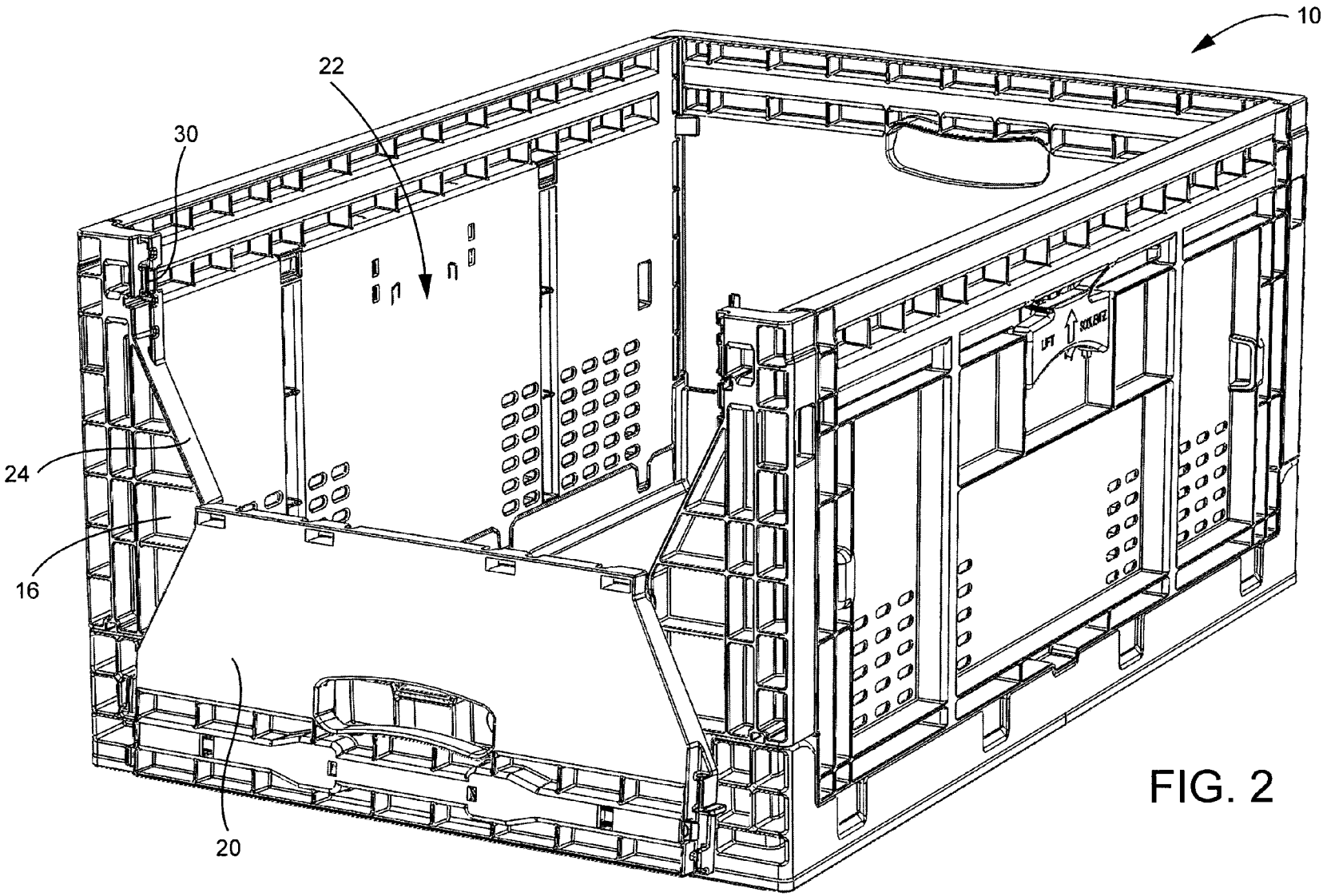
FIG. 2 is a perspective view with the access door down.
Figure 7:
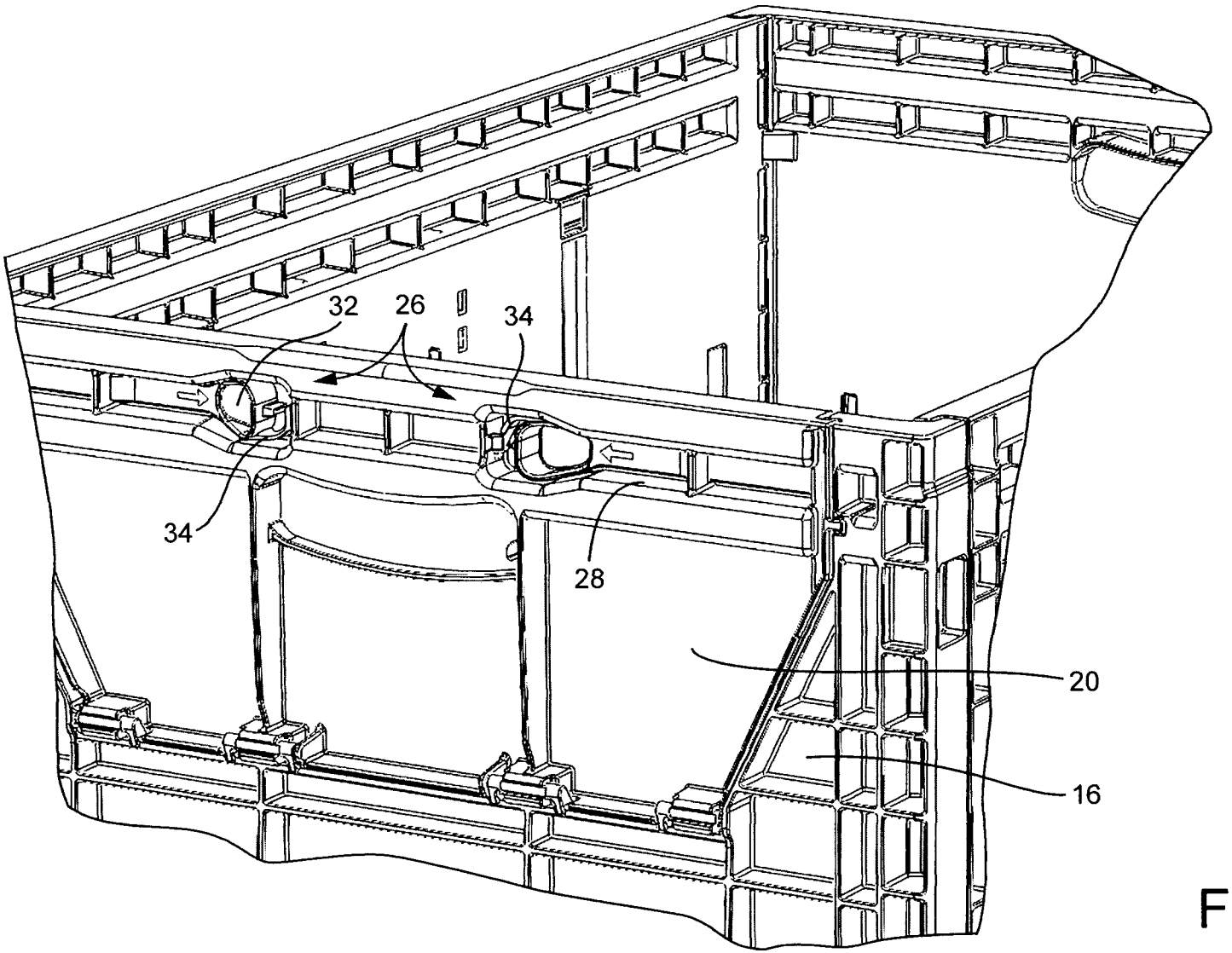
FIG. 7 is a close-up view of the access door latch.

As shown in FIG. 2, the first end wall 16 includes an opening 22 in which the access door 20 is disposed. The opening 22 defines an inner perimeter 24 of the first end wall 16. As shown in FIG. 7, the access door 20 is provided with a door latch 26 that includes at least one part, preferably two, movably secured in a channel 28 in the access door 20. The door latch 26 is extendible into an opening 30 (FIG. 2) in the inner perimeter 24. Preferably, the door latch 26 is displaceable in the channel 28 between a latched position, in which the door latch 26 is extended into the opening 30 in the inner perimeter 24, and a released position, in which the door latch 26 is retracted from the opening 30 in the inner perimeter 24. In the exemplary construction shown in FIG. 7, the door latch 26 includes finger openings 32 so that a user can pinch the latch components together to displace the door latch 26 from the latched position to the released position. The latch parts are preferably biased toward the latched position via a spring component 34 or the like. With the latch parts displaced toward each other in the channel 28, the door latch is displaced to its released position, enabling the access door 20 to be pivoted to its open position (as shown in FIG. 2).

Figure 3:
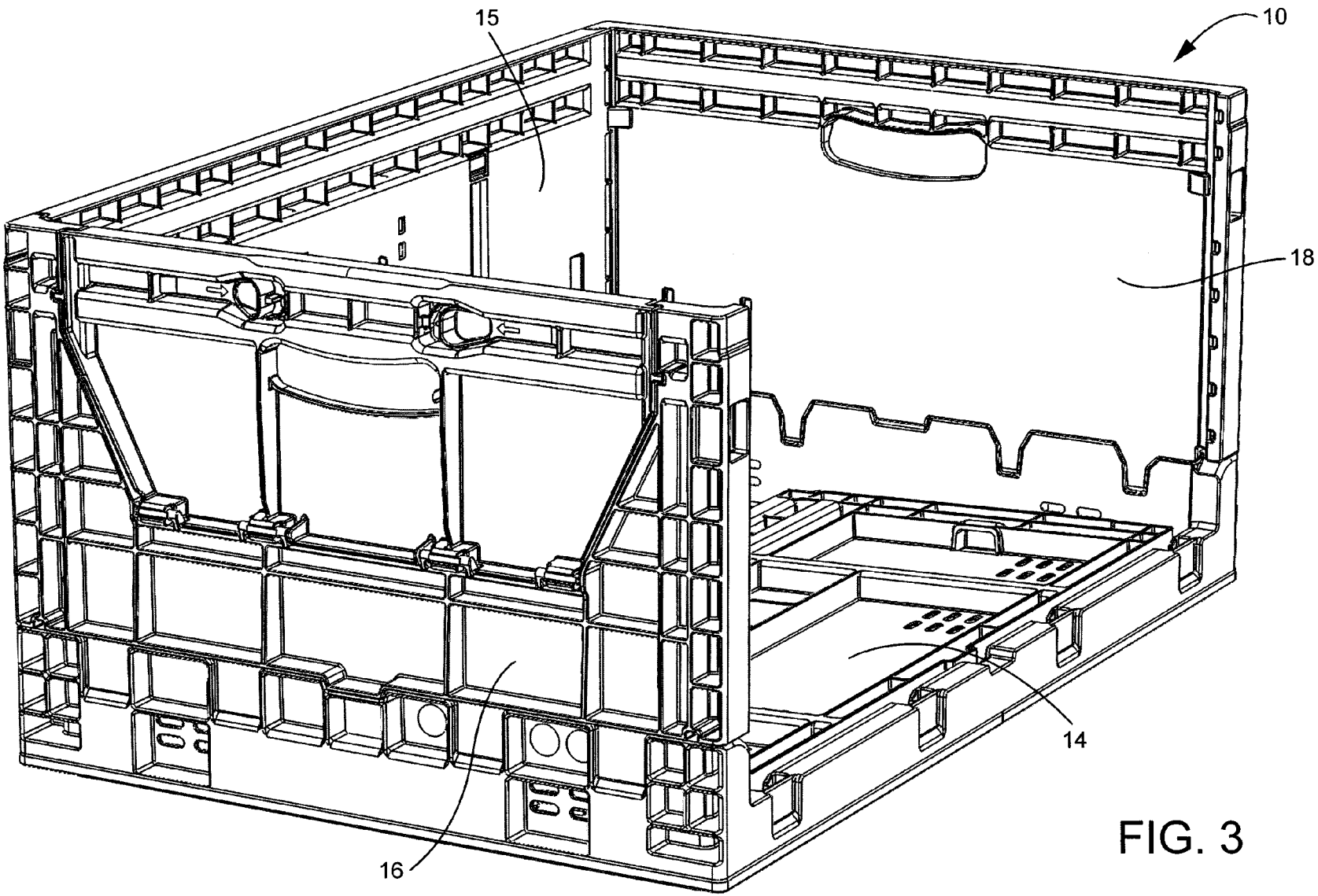
FIGS. 3-6 show the collapsing sequence of the container walls.
Figure 4:
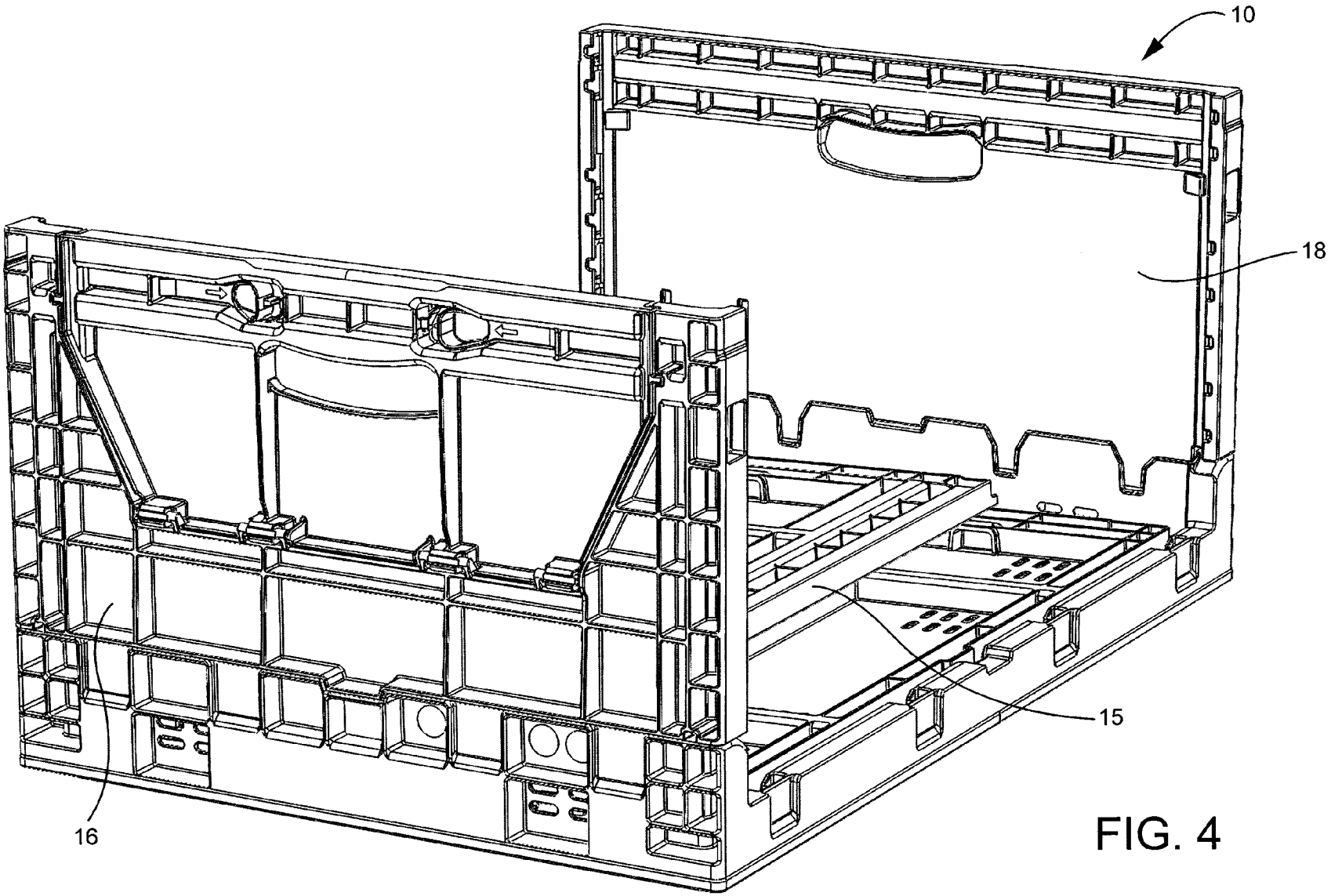
Figure 5:
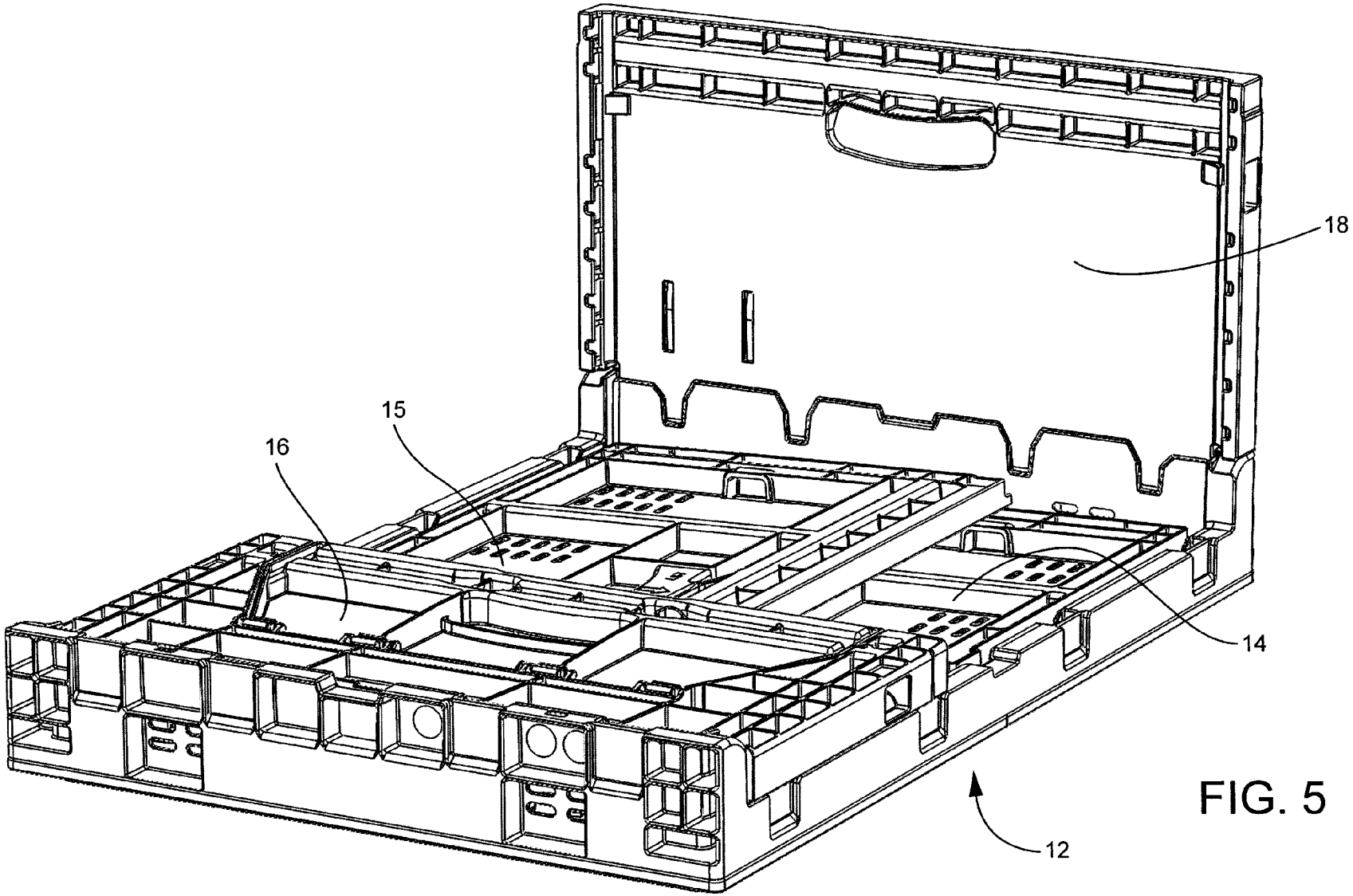
Figure 6:
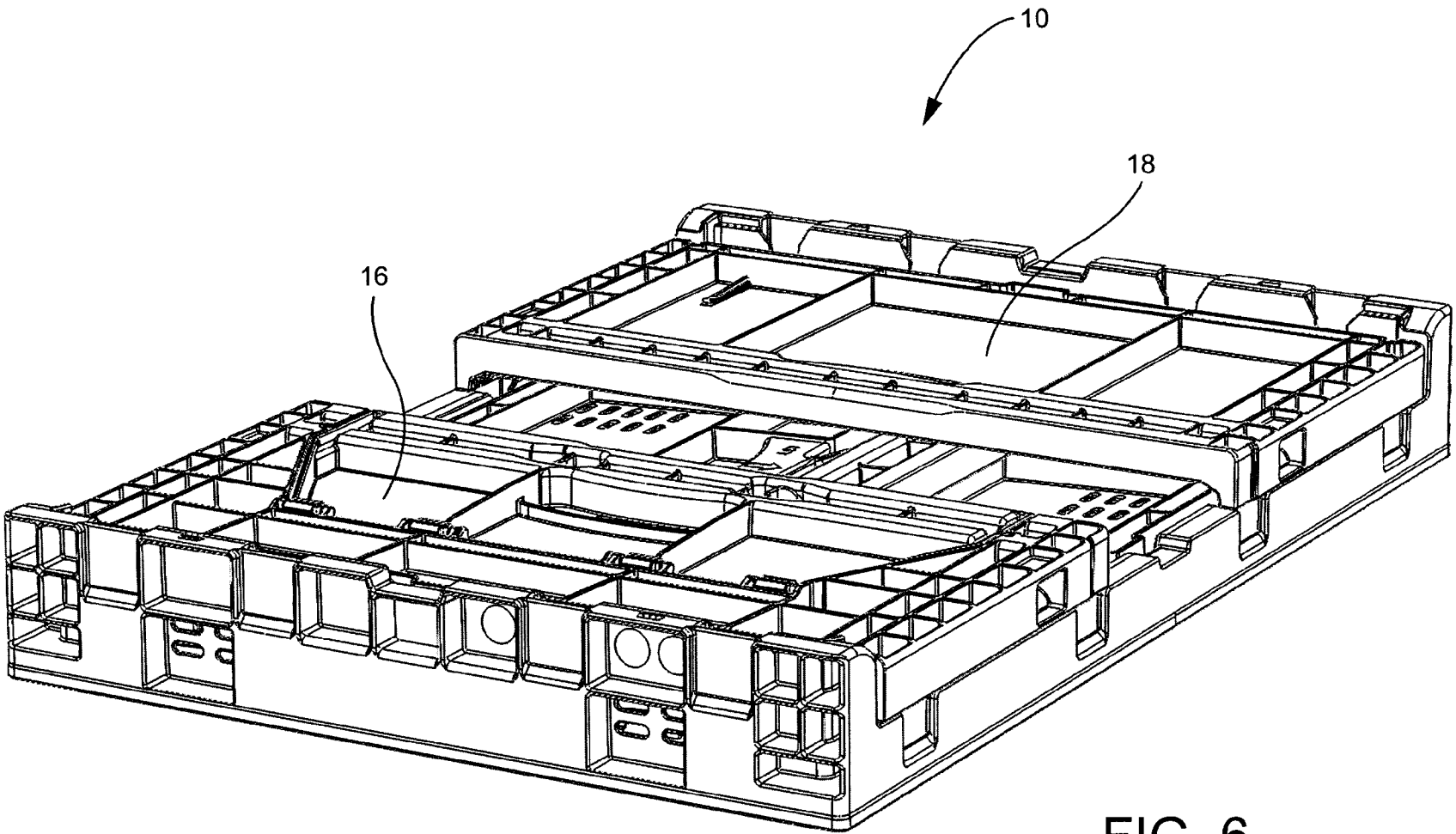

With reference to FIGS. 3-6, the container walls are collapsible in sequence. As shown in FIG. 3, the first side wall 14 is collapsible from an upstanding position to a collapsed position overlaying the bottom wall 12. In FIG. 4, the second side wall 15 is collapsible from an upstanding position to a collapsed position overlaying the collapsed first side wall 14. The first 16 and second 18 end walls are subsequently collapsible from an upstanding position to a collapsed position overlaying the second side wall 15. The first end wall 16 is collapsible regardless of a position of the access door 20. To facilitate the collapsing/folding sequence, a first pivot joint between the first side wall 14 and the bottom wall 12 is preferably spaced closer to the bottom wall 12 than a second pivot joint between the second side wall 15 and the bottom wall 12. This construction enables the second side wall 15 to be collapsed overlaying the first side wall 14. The fully collapsed container is shown in FIG. 6.

Figure 8:
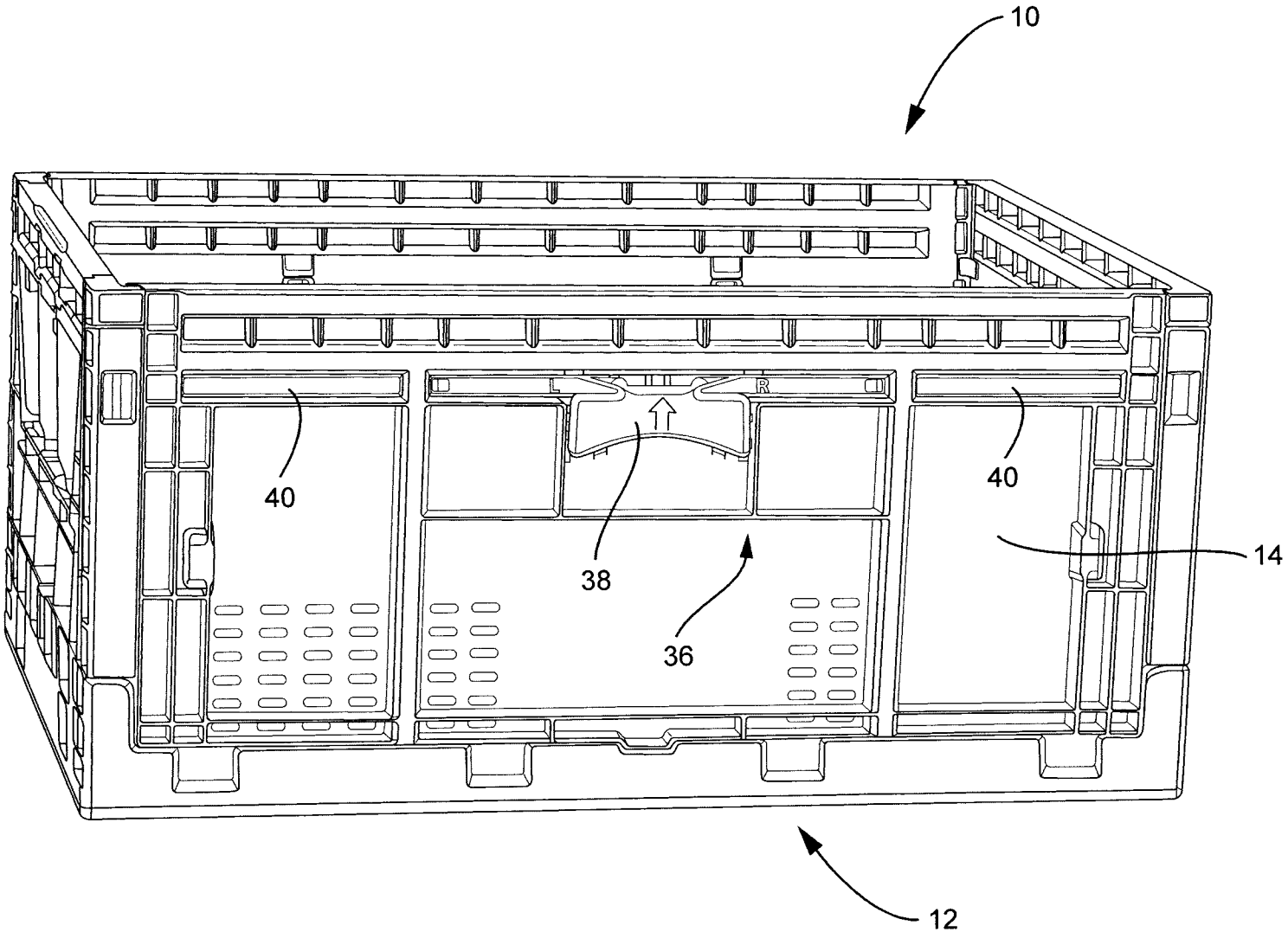
FIGS. 8 and 9 show the locking mechanism of the side walls.
Figure 9:
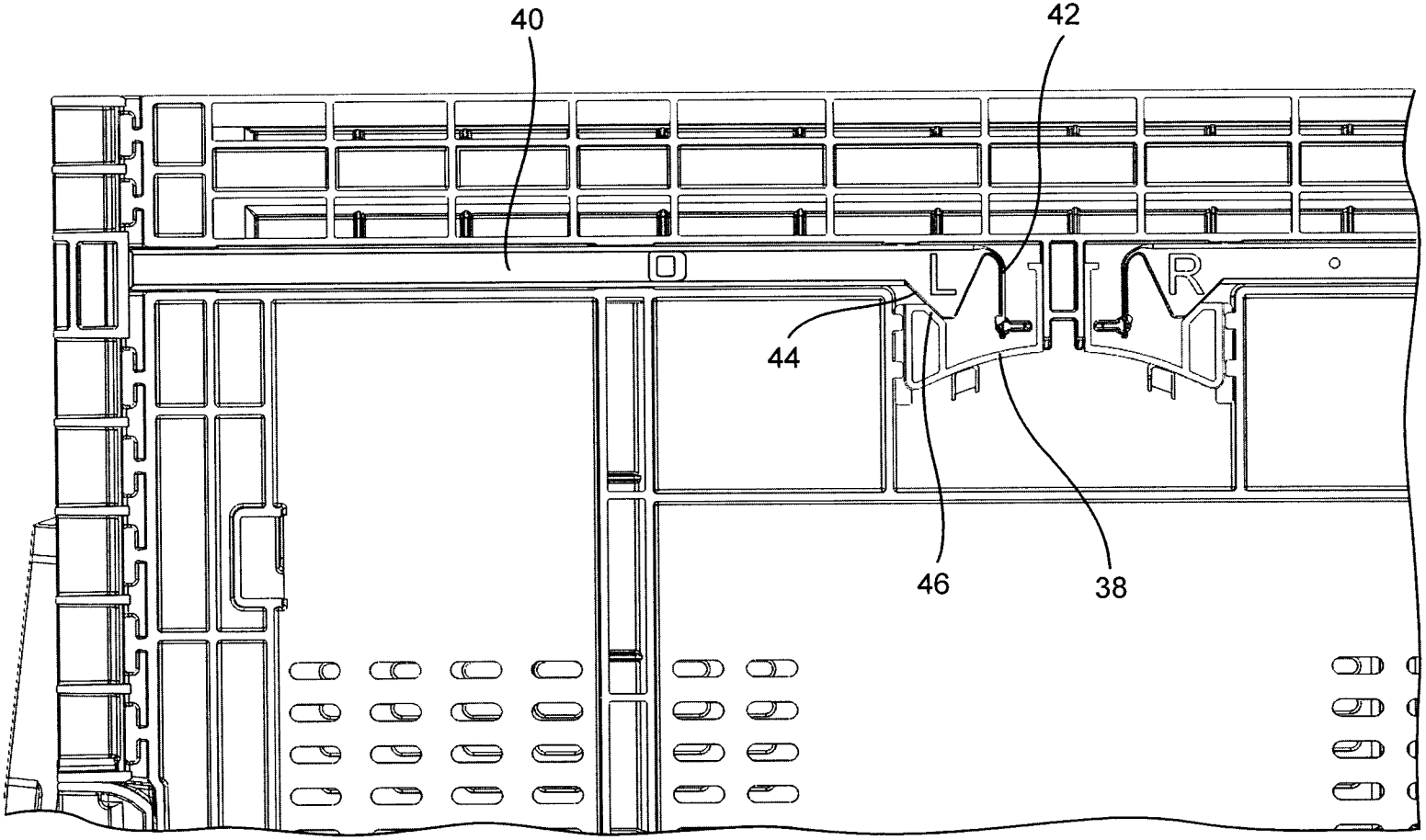

With reference to FIGS. 8 and 9, each of the side walls 14, 15 may be secured in an upstanding position via a wall latch 36. The wall latch 36 includes a handle 38 and latch parts 40. The latch parts 40 are releasably engageable with the first and second end walls 16, 18. Preferably, the latch handle 38 is cooperable with each of the wall latch parts 40 wherein the latch handle 38 is displaceable upward relative to the bottom wall 12 to displace the latch parts inward 40 and thereby release the wall latches from the first and second end walls 16, 18. As shown in FIG. 9, each of the latch parts 40 is biased toward a latched position by a spring element 42. The spring elements 42 urge the latch parts 40 outward into engagement with the first and second end walls 16, 18. Innermost ends of the latch parts 40 include an angled surface 44, and the latch handle 38 includes respective wedge members 46 in engagement with the angled surfaces 44. As the latch handle 38 is pulled upward, the wedge members 46 are driven against the angled surfaces 44, and the latch parts 40 are drawn toward each other against the force of the spring elements 42 into a released position.

The described container provides a unique solution for a collapsible container including an access opening in the front end wall in combination with the folding sequence of the side walls. The assembly and folding sequence facilitate construction and manufacture of the container. Additionally, the access opening facilitates access to the product in the containers.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A collapsible container comprising:

a rectangular bottom wall;

a plurality of walls pivotally connected to the bottom wall, the plurality of walls including first and second side walls disposed in facing relation and first and second end walls disposed in facing relation;

an access door in the first end wall, the access door being pivotable between a closed position and an open position; and a wall latch in each of the first and second side walls, the wall latch including:

latch parts releasably engageable with the first and second end walls, and a latch handle cooperable with the latch parts to release the latch parts from engagement with the first and second end walls, wherein when the latch handle releases the latch parts from engagement with the first and second end walls, the first side wall is collapsible from an upstanding position to a collapsed position overlaying the bottom wall, the second side wall is collapsible from an upstanding position to a collapsed position overlaying the collapsed first side wall, and the first and second end walls are collapsible from an upstanding position to a collapsed position overlaying the second side wall.

2. A collapsible container according to claim 1, wherein a first pivot joint between the first side wall and the bottom wall is spaced closer to the bottom wall than a second pivot joint between the second side wall and the bottom wall, thereby enabling the second side wall to be collapsed overlaying the first side wall.

3. A collapsible container according to claim 1, wherein the first end wall comprises an opening in which the access door is disposed, the opening defining an inner perimeter of the first end wall.

4. A collapsible container according to claim 3, wherein the access door comprises a door latch movably secured in a channel in the access door, the door latch being extendable into an opening in the inner perimeter.

5. A collapsible container according to claim 4, wherein the door latch is displaceable between a latched position, in which the door latch is extended into the opening in the inner perimeter, and a released position in which the door latch is retracted from the opening in the inner perimeter.

6. A collapsible container according to claim 5, wherein the door latch is biased toward the latched position.

7. A collapsible container comprising:

a rectangular bottom wall;

a plurality of walls pivotally connected to the bottom wall, the plurality of walls including first and second side walls disposed in facing relation and first and second end walls disposed in facing relation;

an access door in the first end wall, the access door being pivotable between a closed position and an open position wherein the first side wall is collapsible from an upstanding position to a collapsed position overlaying the bottom wall, the second side wall is collapsible from an upstanding position to a collapsed position overlaying the collapsed first side wall, and the first and second end walls are collapsible from an upstanding position to a collapsed position overlaying the second side wall, and wherein each of the side walls is secured in an upstanding position via a wall latch releasably engageable with the first and second end walls; and a latch handle cooperable with each of the wall latches, wherein the latch handle is displaceable upward relative to the bottom wall to release the wall latches.

8. A collapsible container comprising:

a bottom wall;

a plurality of walls pivotally connected to the bottom wall, the plurality of walls including first and second side walls disposed in facing relation and first and second end walls disposed in facing relation;

an access door in the first end wall, the access door being pivotable between a closed position and an open position relative to the first end wall, wherein the first end wall comprises an opening in which the access door is disposed, the opening defining an inner perimeter of the first end wall; and a wall latch in each of the first and second side walls, the wall latch including:

latch parts releasable engageable with the first and second end walls, and a latch handle cooperable with the latch parts to release the latch parts from engagement with the first and second end walls, wherein when the latch handle releases the latch parts from engagement with the first and second end walls, the first side wall is collapsible from an upstanding position to a collapsed position overlaying the bottom wall, the second side wall is collapsible from an upstanding position to a collapsed position overlaying the collapsed first side wall, and the first and second end walls are collapsible from an upstanding position to a collapsed position overlaying the second side wall.

9. A collapsible container according to claim 8, wherein the first end wall is pivotable relative to the bottom wall regardless of a position of the access door.

10. A collapsible container according to claim 8, wherein the access door comprises a door latch movably secured in a channel in the access door, the door latch being extendable into an opening in the inner perimeter.

11. A collapsible container according to claim 10, wherein the door latch is displaceable between a latched position, in which the door latch is extended into the opening in the inner perimeter, and a released position in which the door latch is retracted from the opening in the inner perimeter.

12. A collapsible container according to claim 11, wherein the door latch is biased toward the latched position.

13. A collapsible container comprising:

a bottom wall;

a plurality of walls pivotally connected to the bottom wall, the plurality of walls including first and second side walls disposed in facing relation and first and second end walls disposed in facing relation;

an access door in the first end wall, the access door being pivotable between a closed position and an open position relative to the first end wall, wherein the first end wall comprises an opening in which the access door is disposed, the opening defining an inner perimeter of the first end wall, wherein the first side wall is collapsible from an upstanding position to a collapsed position overlaying the bottom wall, the second side wall is collapsible from an upstanding position to a collapsed position overlaying the collapsed first side wall, and the first and second end walls are collapsible from an upstanding position to a collapsed position overlaying the second side wall, and wherein each of the side walls is secured in an upstanding position via a wall latch releasably engageable with the first and second end walls; and a latch handle cooperable with each of the wall latches, wherein the latch handle is displaceable upward relative to the bottom wall to release the wall latches.

14. A method of collapsing a collapsible container, the container including a bottom wall, a plurality of walls pivotally connected to the bottom wall, the plurality of walls including first and second side walls disposed in facing relation and first and second end walls disposed in facing relation, an access door in the first end wall, the access door being pivotable between a closed position and an open position, and a wall latch in each of the first and second side walls that includes latch parts releasably engageable with the first and second end walls and a latch handle cooperable with the latch parts, the method comprising:

(a) displacing the latch handle to release the latch parts from engagement with the first and second end walls;

(b) collapsing the first side wall from an upstanding position to a collapsed position overlaying the bottom wall; then, (c) collapsing the second side wall from an upstanding position to a collapsed position overlaying the collapsed first side wall; and then, (d) collapsing the first and second end walls from an upstanding position to a collapsed position overlaying the second side wall.

15. A method according to claim 14, wherein step (d) is practiced regardless of a position of the access door.

16. A method of collapsing a collapsible container, the container including a bottom wall, a plurality of walls pivotally connected to the bottom wall, the plurality of walls including first and second side walls disposed in facing relation and first and second end walls disposed in facing relation, and an access door in the first end wall, the access door being pivotable between a closed position and an open position, the method comprising:

(a) collapsing the first side wall from an upstanding position to a collapsed position overlaying the bottom wall; then, (b) collapsing the second side wall from an upstanding position to a collapsed position overlaying the collapsed first side wall; and then, (c) collapsing the first and second end walls from an upstanding position to a collapsed position overlaying the second side wall, wherein each of the side walls is secured in an upstanding position via a wall latch releasably engageable with the first and second end walls, and wherein steps (a) and (b) are practiced by displacing the wall latch to release the first and second side walls, and wherein the container further comprises a latch handle cooperable with each of the wall latches, and wherein steps (a) and (b) are further practiced by displacing the latch handles upward relative to the bottom wall to release the wall latches.

* * * * *